United States Patent [19]

Ware, Jr.

[11] 4,058,323

[45] Nov. 15, 1977

[54] DIE CAST ROLLER SKATE SOLE PLATE

[75] Inventor: Robert R. Ware, Jr., River Forest, Ill.

[73] Assignee: Chicago Roller Skate Company, Chicago, Ill.

[21] Appl. No.: 679,717

[22] Filed: Apr. 23, 1976

[51] Int. Cl.[2] ..... A63C 17/00

[52] U.S. Cl. ..... 280/11.1 R; 280/11.28

[58] Field of Search ..... 280/11.28, 11.27, 11.19, 280/11.23, 11.1 R, 11.2

[56] References Cited

U.S. PATENT DOCUMENTS

| | | | |
|---|---|---|---|
| 2,233,355 | 2/1941 | Ware | 280/11.28 |
| 2,424,783 | 7/1947 | Ware, Jr. | 280/11.19 |
| 2,502,153 | 3/1950 | Jack | 280/11.28 |
| 3,035,846 | 5/1962 | Asad | 280/11.2 |
| 3,862,763 | 1/1975 | Ware | 280/11.28 |
| D. 162,129 | 2/1951 | Coldwell | 280/11.28 X |

*Primary Examiner*—Joseph F. Peters, Jr.
*Assistant Examiner*—Milton L. Smith
*Attorney, Agent, or Firm*—Olson, Trexler, Wolters, Bushnell & Fosse, Ltd.

[57] ABSTRACT

A light weight, strong die cast sole plate for a roller skate. The sole plate includes an action screw boss and a front truck ball socket in a sole plate toe portion. A central rib extends longitudinally between the action screw boss and the front ball socket. Diagonally disposed ribs extend from one side of the action screw boss to an opposite side of the front ball socket and cross the longitudinal rib. This structure permits production of a strong yet low cost sole plate.

3 Claims, 5 Drawing Figures

DIE CAST ROLLER SKATE SOLE PLATE

BACKGROUND OF THE INVENTION

This invention relates generally to roller skates and more particularly to a roller skate sole plate of low cost, light weight, and great durability.

Rink type roller skates are conventionally provided with a shoe structure secured to a sole plate. From this sole plate, front and rear roller trucks depend. A toe stop, for use in dance and other maneuvers may be secured to the sole plate front. One such sole plate is disclosed and illustrated in U.S. Pat. No. 3,862,763.

The general object of the present invention is to provide a light weight die cast sole plate having great strength and durability. Sole plate strength is especially desirable in a toe portion of the plate which is subjected to the stresses imparted by the front roller truck and the toe stop.

A related object is to provide such a sole plate which can be manufactured at relatively modest cost and which requires but a minimum of constituent raw material.

Other objects and advantages of the invention will become apparent upon reading the following detailed description and upon reference to the drawings. Throughout the drawings, like reference numerals refer to like parts.

DETAILED DESCRIPTION

While the invention will be described in connection with a preferred embodiment, it will be understood that it is not intended to limit the invention to this embodiment. On the contrary, it is intended to cover all alternatives, modifications and equivalents as may be included within the spirit and scope of the invention as defined by the appended claims.

Figure 1:
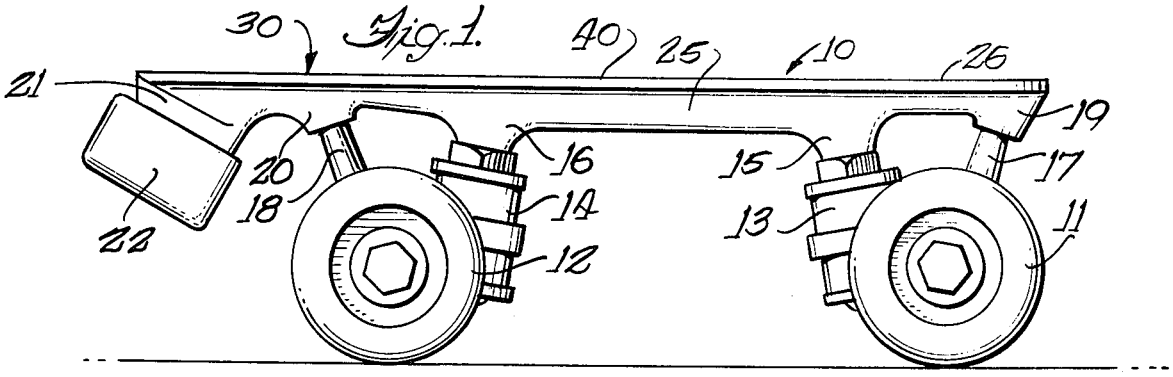
FIG. 1 is a side elevational view showing the novel sole plate of the present invention together with supporting roller trucks and a toe stop.
Figure 2:
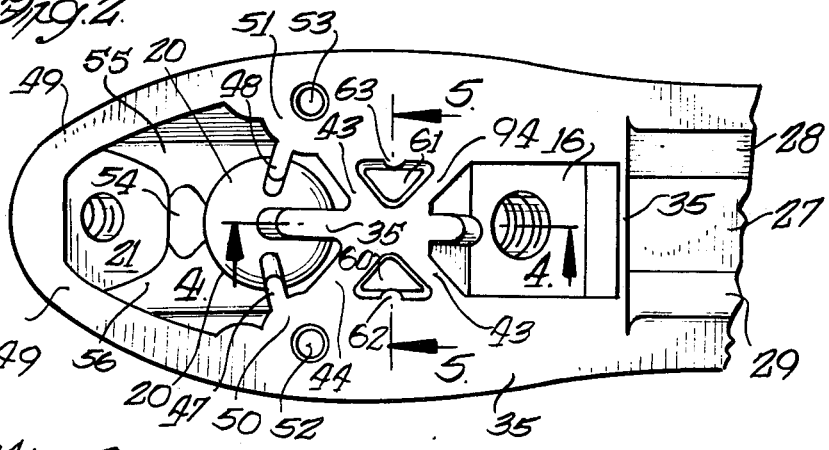
FIG. 2 is a fragmentary top plan view of the sole plate shown in FIG. 1.
Figure 3:
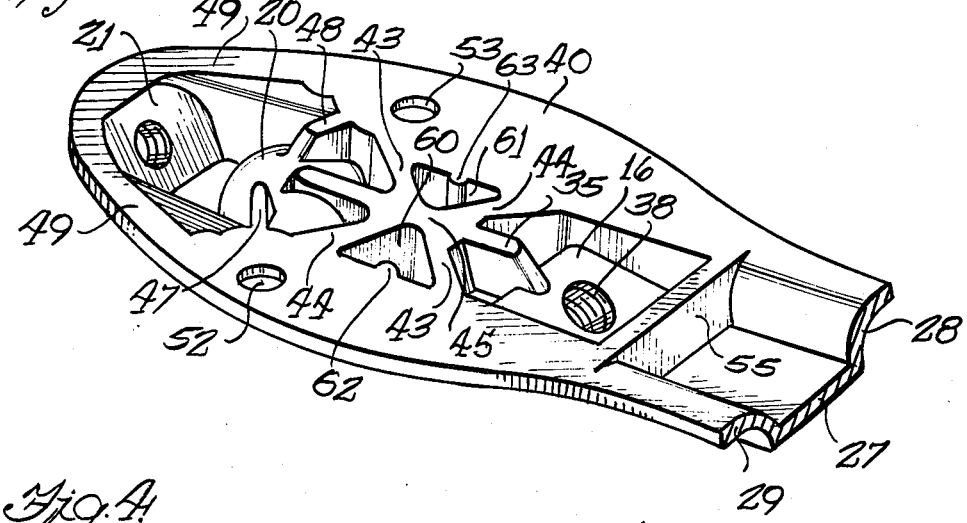
FIG. 3 is a fragmentary perspective view of the sole plate toe portion.

Turning first to FIG. 1, there is shown a novel sole plate 10 embodying the present invention as it appears when supported by a rear roller truck 11 and a front roller truck 12. To provide a desired roller skate ride or "feel," front and rear action mechanisms 13 and 14 extend between a lower portion of the respective trucks 11 and 12 and sole plate embossments 15 and 16. To permit truck rotation relative to the sole plate 10, each truck includes a strut 17 and 18 which extends into a strut-accomodating ball socket embossment 19 or 20, respectively. A front or toe embossment 21 supports a toe stop 22.

In accordance with the invention, a light weight sole plate can be provided at an inexpensive finished cost by die casting the sole plate 10 from a suitable metal such as aluminum or an aluminum alloy. In the rear portions of the sole plate 10, such as an instep portion 25 and a heel portion 26, the desired lightness and strength can be provided by shaping the sole plate so as to provide a channel-like structure having a bottom 27 and upwardly and outwardly flaring sides 28 and 29.

Figure 4:
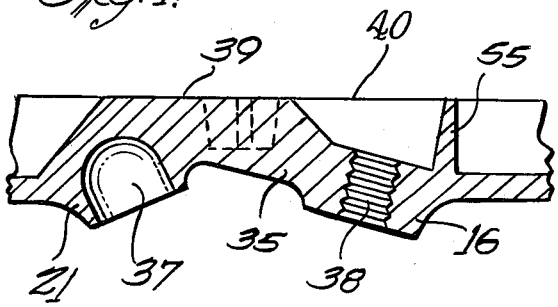
FIG. 4 is a fragmentary sectional view taken substantially in the plane of line 4—4 in FIG. 2.
Figure 5:
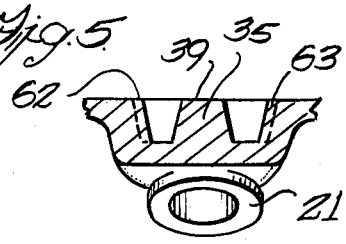
FIG. 5 is a fragmentary sectional view taken substantially in the plane of line 5—5 in FIG. 2.

In accordance with the invention, strength yet lightness is provided in a sole plate toe portion 30 by casting the sole plate metal so as to form a longitudinally extending central rib 35 running between the action screw boss 16 and the front ball socket 20. So as to most effectively accommodate stresses imparted to the sole plate in the toe area 30, this longitudinally extending rib 35 is aligned with the front truck strut ball socket 37 and the front truck action mechanism screw socket 38, as can be especially envisioned from FIG. 4. This rib 35 terminates in a top surface 39 lying in a plane 40 defining the top of the remaining portion of the sole plate 10.

Torsional and other forces are imparted to the toe and sole plate 10 during skate turns and other maneuvers, and to accommodate these stresses the sole plate toe area 30 includes two diagonally disposed ribs 43 and 44 which cross the longitudinally extending rib 35 at an intermediate point 45. To maximize stress accommodation, these longitudinal but diagonally disposed ribs 43 and 44 extend from one side of the action screw boss 20 to an opposite side of the front ball socket 16. These diagonal ribs 43 and 44, too, rise to the top plane 40 of the sole plate.

It is a feature of the invention that additional strength can be provided to the front ball socket 20 by auxiliary ribs 47 and 48 which extend diagonally rearwardly from the front ball socket 20 toward the sole plate periphery 49. Here, these ribs terminate in embossments 50 and 51 which surround and help define apertures 52 and 53 adapted to receive rivets (not shown) for attaching a shoe to the sole plate 10. Forward of the ball socket 20, the sole plate again takes the form of a channel having a bottom 54 flaring upward and outwardly into arms 55, 56 terminating in the periphery 49. At the rear of the toe portion 30, transverse rib 55 extends between the channel sides 28 and 29 and, like the other ribs, terminates at plate top in the planer surface 40.

When so formed, this sole plate 10 can be accurately die cast of light weight yet strong materials. The described ribs, boss, and socket portions define recesses 60 and 61 for added lightness. Additionally, the described structure provides ribs having relatively uniform rib thicknesses. As molten cast metal cools and solidifies within the sole plate die during manufacture, relatively small crystalline structural growth occurs within the die cast sole plate. It has been found that this relatively small crystalline structure increases and encourages sole plate strength to a surprising degree.

It is a feature of the invention that the sole plate die casting can be cleaned and its strength further increased by shot peening after casting. To prevent lodgement of shot peening material in the recesses 60 and 61, auxiliary bead formations 62 and 63 can be provided to protrude marginally into the recess 60 and 61.

The invention is claimed as follows:

1. A lightweight, strong sole plate for a roller skate and formed of small crystalline structure cast metal, the plate including a raised periphery, an action screw boss, a front truck ball socket, a longitudinal rib of uniform cross section extending between the screw boss and the front ball socket, and at least two diagonally disposed ribs of a uniform cross section, each rib extending from the sole plate periphery on a given side of the action screw boss to the periphery on an opposite side of the front ball socket and crossing the other diagonally disposed rib and the longitudinal rib at a given point between the action screw boss and the front ball socket, the uniform rib thicknesses encouraging relatively small crystalline structural growth during solidification of liquid metal into the cast metal sole plate, the periphery and the two diagonal ribs together defining two recesses, one recess located on either side of the longitudinal rib, and the periphery defining auxiliary bead formations extending into the recesses sufficiently to prevent lodgement of shot peening materials in the recesses during sole plate casting cleaning.

2. A sole plate according to claim 1 including at least one auxiliary rib extending diagonally rearwardly from the front ball socket towards the sole plate periphery.

3. A sole plate according to claim 1 including a transverse rib extending laterally across the sole plate at a position located rearwardly of the front truck action screw boss.

* * * * *